US007066752B2

(12) United States Patent
Hsu et al.

(10) Patent No.: US 7,066,752 B2
(45) Date of Patent: Jun. 27, 2006

(54) SLIDE-IN STRUCTURE

(75) Inventors: Hsi-Hsing Hsu, Taoyuan (TW); Chu-Yang Chu, Hsinchu (TW); Chien-Lung Huang, Taipei (TW); William Wang, Taipei (TW); Leader Hung, Taoyuan (TW)

(73) Assignee: High Tech Computer, Corp., Tao Yuan (TW)

( * ) Notice: Subject to any disclaimer, the term of this patent is extended or adjusted under 35 U.S.C. 154(b) by 299 days.

(21) Appl. No.: 10/604,690

(22) Filed: Aug. 11, 2003

(65) Prior Publication Data

US 2004/0229494 A1 Nov. 18, 2004

(30) Foreign Application Priority Data

May 14, 2003 (TW) ..... 92208777 U

(51) Int. Cl.
*H01R 13/64* (2006.01)

(52) U.S. Cl. ..... 439/248; 439/342; 439/929

(58) Field of Classification Search ..... 439/246–249, 439/252, 374, 376, 67, 929, 342–343; 320/115
See application file for complete search history.

(56) References Cited

U.S. PATENT DOCUMENTS 5,764,497 A * 6/1998 Mizumo ..... 439/65
6,049,192 A * 4/2000 Kfoury et al. ..... 320/115
6,758,690 B1 * 7/2004 Yu et al. ..... 439/140

* cited by examiner

*Primary Examiner*—P. Austin Bradley
*Assistant Examiner*—Felix O. Figueroa
(74) *Attorney, Agent, or Firm*—Jiang Chyun IP Office

(57) ABSTRACT

A slide-in structure (210) inside a cradle set (200) for accommodating a personal digital assistant (PDA) module (10) is disclosed. The slide-in structure comprises a base plate (220), a sliding stand (230) and a pushing arm (240). A connector (204) of the cradle set is fastened to the sliding stand via a circuit board (206). The base plate has a pair of sidewalls (222, 224) and two sliding grooves (226) located on of the sidewalls. The two ends of the sliding stand are inserted into the respective sliding grooves so that the sliding stand is free to move relative to the sliding grooves. The pushing arm is in contact with the sliding stand. The pushing arm resiliently pushes the sliding stand to one side of the sliding grooves and provides a buffering force when the PDA module engages with/disengages from the connector in the cradle set.

16 Claims, 5 Drawing Sheets

SLIDE-IN STRUCTURE

CROSS REFERENCE TO RELATED APPLICATIONS

This application claims the priority benefit of Taiwan application serial no. 92208777, filed May 14, 2003.

BACKGROUND OF INVENTION

1. Field of the Invention

The present invention generally relates to a slide-in structure, and more particularly, the present invention relates to a slide-in structure having a buffered self-alignment connector used in a cradle set for a handheld electronic device.

2. Description of the Related Art

Personal digital assistant (PDA) is one of the most common portable entertainment tools to be carried around in our daily life. At first, the PDA was designed as a general-purpose electronic notebook for managing traveling schedules, recording events and logging communication. However, as computational speed of computers continues to increase, and networking and wireless communication continues to advance, the PDA is used for communication, network surfing, playing games or serving as a multimedia. Thus, a PDA is often regarded as a "palm-top computer".

In general, each PDA has multi-functional connectors such as a power connector, an input/output (I/O) connector and an external card connector. Most power connectors are positioned at the bottom section of the PDA by design. To charge up the battery inside the PDA, one end (the female section) of the power connector within the PDA is inserted into a corresponding end (the male section) of a power connector within a cradle set. Similarly, most of the I/O connectors are positioned at the bottom section of the PDA by design. To transfer data between the PDA and a computer, one end (the female section) of the I/O connector within the PDA is inserted into a corresponding end (the male section) of an I/O connector within a cradle set connected to the computer. The connector in the cradle set is normally fixed on a circuit board with the circuit board fastened to a base plate using a set of screws.

FIG. 1 is a sectional view showing a conventional structure for fastening a connector 104 to a cradle set 100. To facilitate the insertion of a connector 20 (a female connector) at the bottom end of a PDA module 10 to the connector 104 (a male connector), the cradle set 100 is usually designed to enclose the connector 104. The cradle set 100 mainly comprises an insertion slot 102, the connector 104, a circuit board 106 and a base plate 108. The insertion slot 102 is designed to accommodate the bottom end of the PDA module 10. One end of the connector 104 protrudes in the insertion slot 102 so that the connector 104 can engage with the connector 20 at the bottom end of the PDA module 10 tightly. In addition, the circuit board 106 is firmly attached to the base plate 108. Note that when the PDA module 10 is inserted into the insertion slot 102, the backside 12 of the PDA module 10 may rest on the interior sidewall of the insertion slot 102 at a slant angle. Moreover, the connector 104 is fixed onto the circuit board 106 perpendicularly so that the connector 104 protrudes in the insertion slot 102 at the same slant angle.

Since the connector 104 is firmly attached to the cradle set 100 through a series of fastening structures (including the circuit board 106, the base plate 108 and a screw 110), the connector 104 scarcely has a positional tolerance in mating with the connector 20 of the PDA module 10. That is, if the PDA module 10 is inserted into the cradle set 100 at a condition that the connector 20 is not precisely aligned with the connector 104, a bending force is exerted to the connector 104. The bending force can cause the bonding section between the connector 104 in the cradle set 100 and the circuit board 106 to be broken after repeated misaligned mating between the connector 20 of the PDA module 10 and the connector 104 in the cradle set 100. Thereafter, an improper connection between the connector 20 of the PDA module 10 and the connector 104 of the cradle set 100 may occur. In addition, the fastening structure of the connector 104 also has very little capacity to buffer any shock or vibration. If the connector 104 is subjected to an external vibrating force, the bond joining the connector 104 and the circuit board 106 together may separate leading a drop in the reliability of connection.

SUMMARY OF INVENTION

Accordingly, one object of the present invention is to provide a slide-in structure for a personal digital assistant (PDA) cradle set capable of increasing flexibility and reducing alignment stress when a PDA module is inserted into the cradle set to engage with a connector within the cradle set.

A second object of this invention is to provide a slide-in structure for a personal digital assistant (PDA) cradle set. The slide-in structure deploys a sliding stand to serve as a fastening structure for the connector in the cradle set so that the connector within the cradle set for engaging with a PDA module is protected against any damages resulting from undesirable external forces.

To achieve these and other advantages and in accordance with the purpose of the invention, as embodied and broadly described herein, the invention provides a slide-in structure for a connector of a cradle set. The slide-in structure mainly comprises a base plate, a sliding stand and a pushing arm. The connector within the cradle set is mounted on the sliding stand via a circuit board. The base plate has a pair of sidewalls and a pair of sliding grooves located on the opposite inner surface of the sidewalls. The ends of the sliding stand are positioned within the respective sliding grooves so that the sliding stand is free to move along the sliding grooves. In addition, the pushing arm is secured to the base plate with one end in contact with the sliding stand surface. Through a resilient force provided by the pushing arm, the sliding stand is stationed somewhere within the sliding grooves and buffered by the pushing arm.

According to one embodiment of this invention, the sliding grooves can be arc-shaped slots and each end of the sliding stand can be an arc-shaped sliding block so that the sliding blocks are free to move forward and backward inside the sliding groves. However, the sliding grooves can be an arc-shaped slot and each end of the sliding stand can be a spherical sliding block so that the sliding blocks not only can slide inside the sliding grooves but also rotate within the sliding grooves.

According to one embodiment of this invention, the pushing arm is solidly locked onto the base plate or the cradle. In addition, the pushing arm has a protruding surface that forms a surface contacting with the sliding stand.

In this invention, the slide-in structure buffers the connector in the cradle set against any stress due to misalignment and external vibrating force. Furthermore, the sliding stand of this invention is able to provide positional tolerance for the connector in the cradle set in mating with the connector of the PDA module, in comparison with the conventional fixed connector design.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Figure 1:
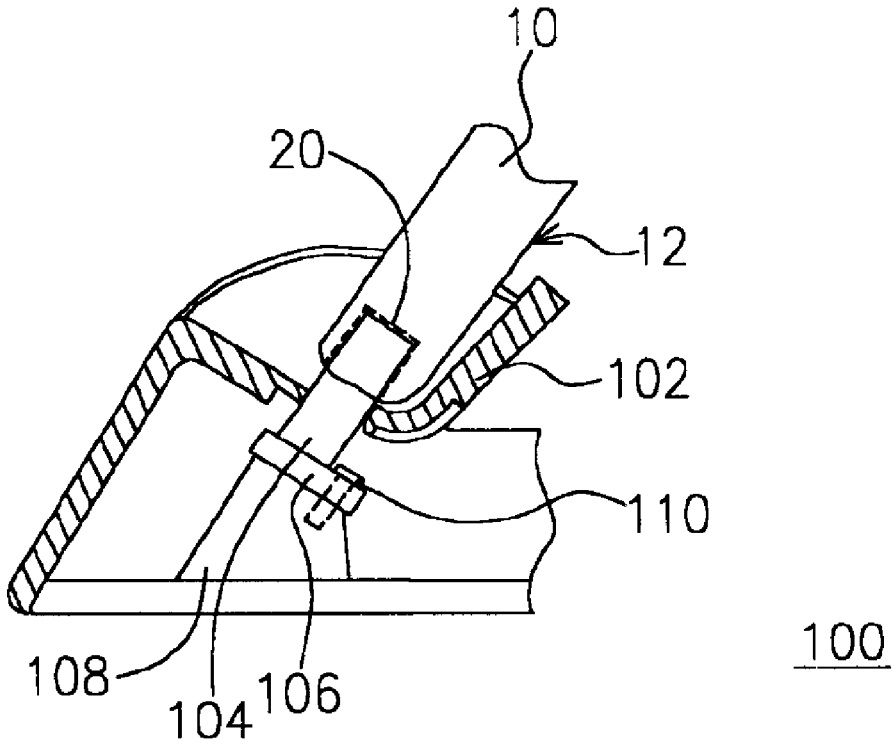
FIG. 1 (PRIOR ART)
FIG. 1 is a sectional view showing a conventional structure for fastening a connector to a cradle set and a PDA module mounted on the cradle set.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
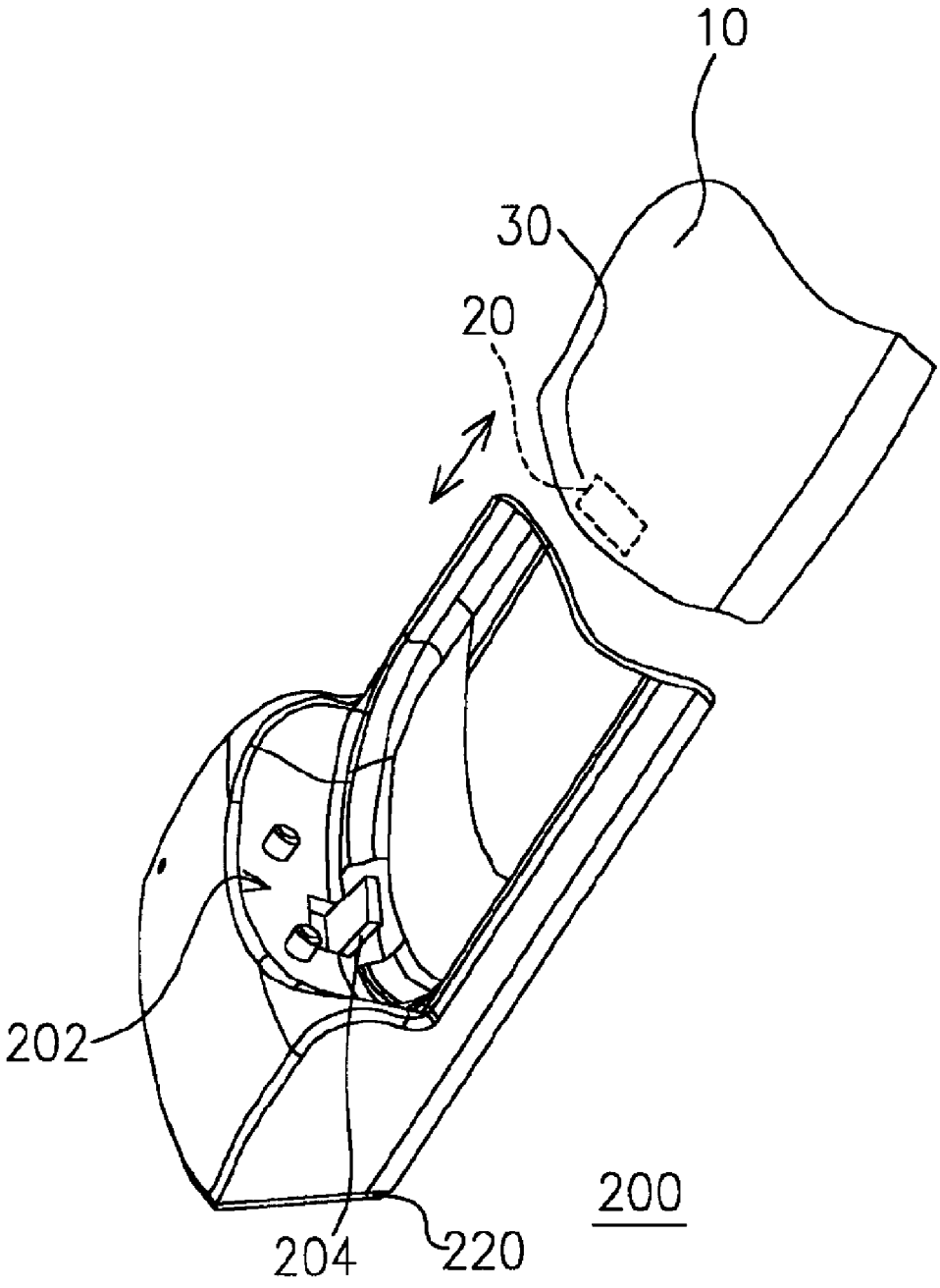
FIG. 2A is a perspective view showing a PDA module to be mounted to a PDA cradle set incorporating a slide-in structure in accordance with the present invention.

As shown in FIG. 2A, a PDA module 10 has a connector terminal 30. The connector terminal 30 is located at a bottom end of the PDA module 10, for example. The connector terminal 30 is the end that has a built-in connector 20 (a female connector) for engaging with another connector 204 (a male connector) in a cradle set 200. In this embodiment, the PDA module 10 is used in the illustration. However, the application of this invention is not limited to the PDA module. For example, other devices such as PDA type mobile phones, smart phones or portable electronic devices having a function similar to the PDA module may also deploy the slide-in structure described in this invention.

Figure 2B:
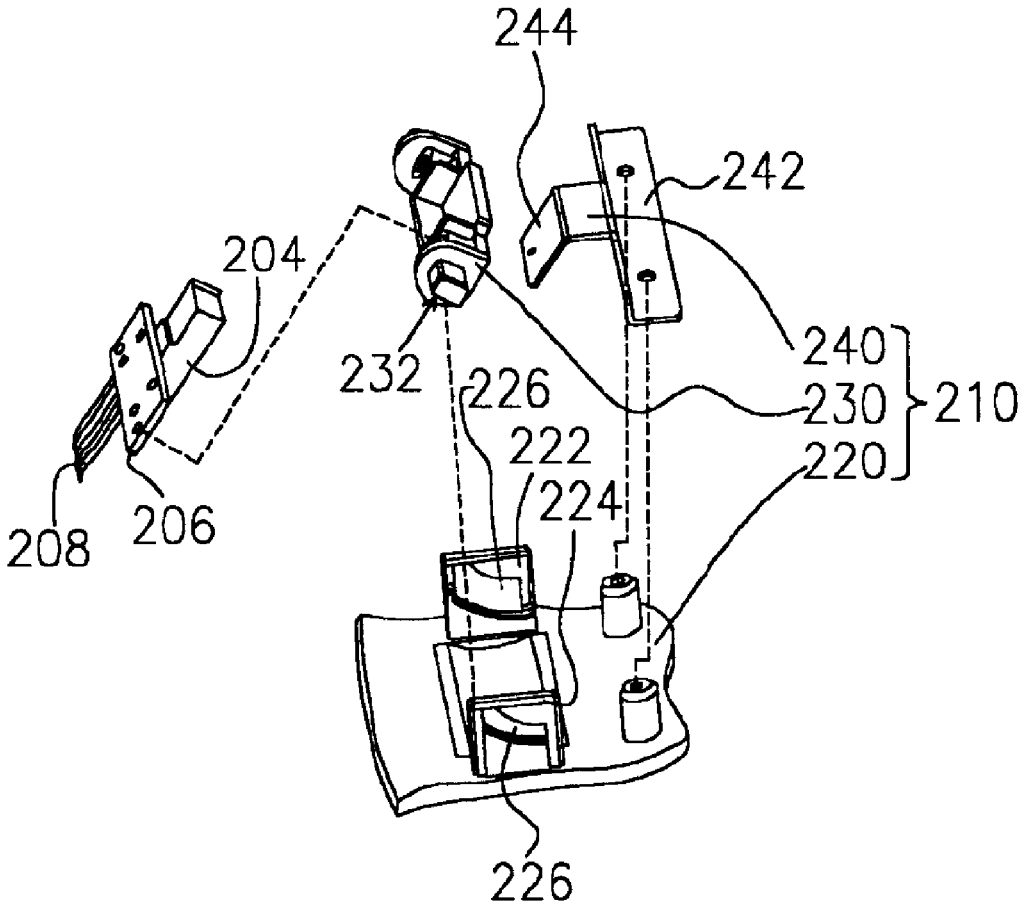
FIG. 2B is an exploded view of the slide-in structure in accordance with the present invention.

A slide-in structure 210 as shown in FIG. 2B mainly comprises a base plate 220, a sliding stand 230 and a pushing arm 240. A connector 204 within the cradle set 200 is firmly mounted (locked) on the sliding stand 230 via a circuit board 206. The circuit board 206 is electrically connected to a main circuit board (not shown) through a flexible printed circuit 208. The base plate 220 has a pair of sidewalls 222, 224 and a corresponding pair of sliding grooves 226 located on the respective sidewalls 222, 224. The two ends of the sliding stand 230 are inserted into the respective sliding grooves 226 so that the sliding stand 230 is free to move forward or backward. Preferably, each of the sliding grooves 226 is an arc-shaped slot and each end of the sliding stand 230 has an arc-shaped sliding block 232 so that the sliding stand 230 can slide smoothly along the sliding grooves 226 through the sliding blocks 232. When the PDA module 10 is plugged to or unplugged from the cradle set 200, the connector 204, which is movably mounted in the cradle set 200, can move following the movement of the connector 20 of the PDA module 10. Thus, a bending stress, which may occur to the connector in the cradle set when mounting or dismounting the PDA module to/from the cradle set is obviated in the present invention.

Figure 3:
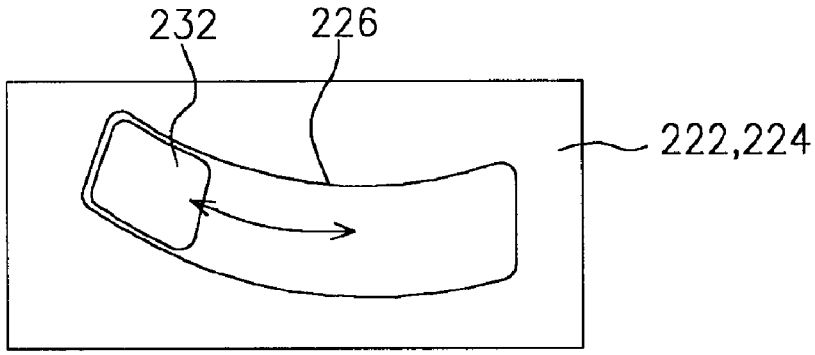
FIGS. 3 through 5 show three types of sliding mechanism employed by the slide-in structure according to this invention.
Figure 4:
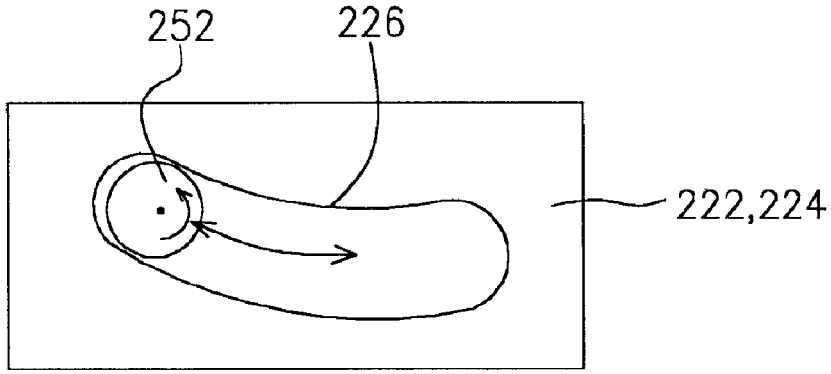
Figure 5:
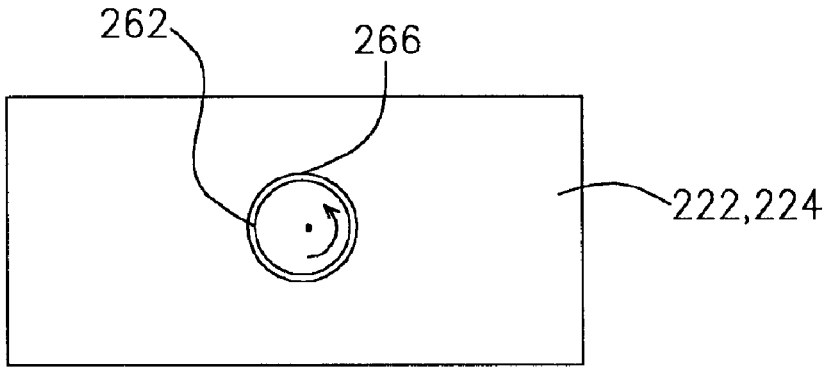

FIGS. 3 through 5 show three types of sliding mechanisms employed by the slide-in structure according to this invention. In FIG. 3, the sliding grooves 226 on the sidewalls 222, 224 are arc-shaped slots and the ends of the sliding stand 230 have arc-shaped sliding blocks 232. The sliding block 232 and the sliding groove 226 are fitted together with a suitable tolerance so that the sliding block 232 is free to move forward and backward smoothly along the groove 226. In FIG. 4, the ends of the sliding stand 230 have round sliding blocks 232. Aside from sliding forward and backward inside the grooves 226, the sliding blocks 252 are free to rotate inside the grooves 226 as well. Obviously, the sliding stand 230 may be constrained to rotate only (without sliding) as shown in FIG. 5. In this case, the round blocks 262 at the ends 262 of the sliding stand 230 are rotatably fitted in corresponding round holes 266 in the sidewalls 222, 224 so that the blocks 262 and accordingly the sliding stand 230 rotate around the axis of the holes 266 to provide the required following-up movement of the connector 204 with the connector 20 when mounting/dismounting the PDA module 10 to/from the cradle set 200.

As shown in FIG. 2B, a bottom section 242 of the pushing arm 240 is fastened to the base plate 220 of the cradle set 200. One end of the pushing arm 240 is in contact with the surface of the sliding stand 230. Through the resilient pushing action of the pushing arm 240, the sliding stand 230 is positioned on one side of the sliding grooves 226 when there is no other external force acting on the connector 204 and the sliding stand 230. Preferably, the pushing arm 240 has a protruding surface 244 in surface contact with the sliding stand 230 so that the sliding stand 230 is stationed at a particular location within the sliding grooves 226. Obviously, instead of the pushing arm 240, some elastic body structure (for example, a spring) and a lever together can be used to provide the resilient pushing action.

Figure 6A:
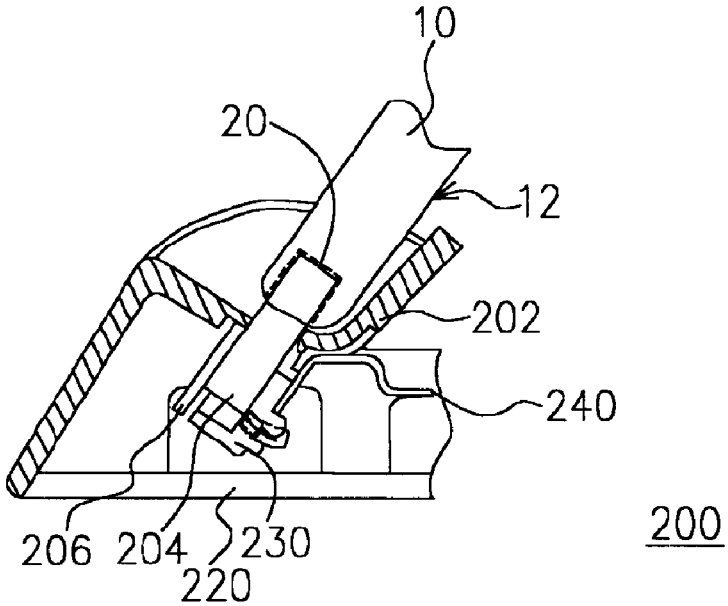
FIGS. 6A and 6B are schematic cross-sectional views showing mounting of the PDA module to the PDA cradle set of this invention at different positions.
Figure 6B:
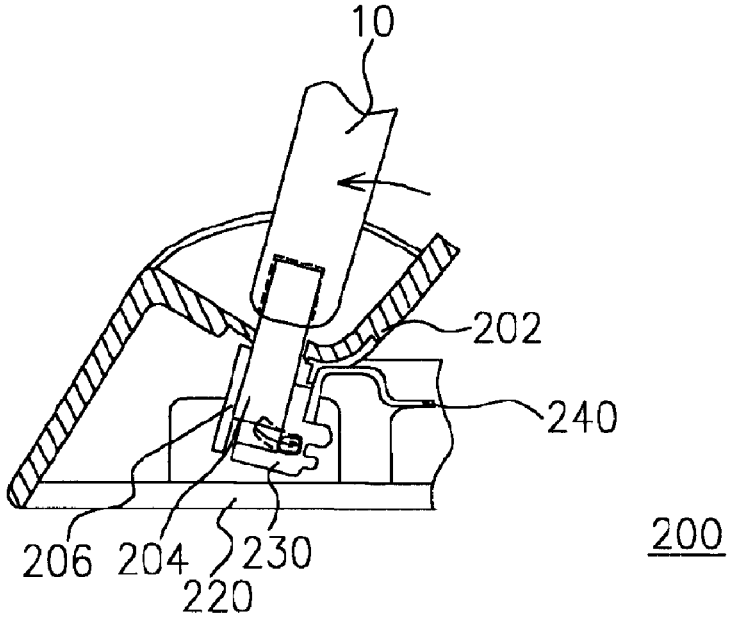

FIGS. 6A and 6B are schematic cross-sectional views showing the insertion of the PDA module 10 to the connector 204 of the PDA cradle set 200 of this invention at different positions. The cradle set 200 comprises a plugging slot 202, the connector 204, the circuit board 206, the base plate 220, the sliding stand 230 and the pushing arm 240. The plugging slot 202 is able to accommodate the connector 20 of the PDA module 10. Moreover, a back surface 12 of the PDA module 10 may rest on the interior sidewall of the plugging slot 202 at a slant angle when the PDA module 10 is inserted into the plugging slot 202. In addition, one end of the connector 204 protrudes in the plugging slot 202 for engaging tightly with the connector 20 of the PDA module 10.

As shown in FIG. 6A, the slide-in structure 210 supporting the connector 204 provides a suitable alignment tolerance to the connector 204 so that bending force acting on the connector 204 when the PDA module 10 and the cradle set 200 are engaged together is minimized. Hence, reliability of the engagement of the connector 20 with the connector 204 is increased. By the gravity of the PDA module 10 and the pushing force of the protruding surface 244 of the pushing arm 240 acting on the sliding stand 230, after the PDA module 10 is mounted on the cradle set 200, the back surface 12 of the PDA module 10 is proximate to the interior sidewall of the plugging slot 202, in which the connector 204 protrudes in the plugging slot 202 at a slant angle similar to that of the interior sidewall of the plugging slot 202.

As shown in FIG. 6B, when the PDA module 10 is unplugged from the connector 204 of the cradle set 200, the slide-in structure 210 serves as a buffer absorbing bending force the PDA module 10 acting on the connector 204. In a conventional fastening structure, if a user forgets to unplug the PDA module 10 along the original slant, the user may rotate the PDA module with a certain extent before pulling it up. Hence, the connector 104 will be bent and damaged. In this invention, however, the pushing arm 240 is designed to provide some buffering permitting the connector 204 to move towards the lower right corner of the grooves 226 to thereby prevent the connector 204 from being overstressed Therefore, reliability of engagement of the connector 204 with the connector 20 and overall working life of the connector 204 are improved.

In summary, this invention provides a slide-in structure for a PDA module cradle set. The slide-in structure comprises a base plate, a sliding stand and a resilient pushing arm. The connector within the cradle set is mounted on the sliding stand via a circuit board. The ends of the sliding stand are fitted into respective grooves on sidewalls of the base plate so that the sliding stand is free to move relative to the sliding grooves. In addition, the pushing arm positioned between the two sidewalls of the base plate engages with the surface of the sliding stand. Through the resilient pushing action of the pushing arm, the sliding stand is stationed at a fixed positioned within the sliding grooves. When the PDA module is plugged into or unplugged from the cradle inappropriately, the slide-in structure is specially designed to prevent any damage to the connector. In other words, the connector can have a longer working life and a better engagement reliability with the connector in the PDA module. Furthermore, the slide-in structure also reduces the amount of stress incurred to the connector in the cradle set when the PDA module is engaged to/disengaged from the connector within the cradle set.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A slide-in structure for a cradle set having a connector and a circuit board, the slide-in structure at least comprising:

a base plate having a pair of sidewalls and a pair of voids in the sidewalls, respectively;

a slide stand positioned between the two sidewalls that two ends of the sliding stand are inserted into the respective voids, wherein the connector is fastened to the sliding stand via the circuit board, the ends of the sliding stand via the circuit board, the ends of the sliding stand are movable received in the voids and the sliding stand is movable relative to the sidewalls; and a pushing arm positioned between the two sidewalls of the base plate, having a portion in contact with a surface of the sliding stand for resiliently pushing the sliding stand.

2. The slide-in structure of claim 1, wherein each void is an arc-shaped slot and each end of the sliding stand has a round sliding block sliding block movably fitted in a corresponding void.

3. The slide-in structure of claim 1, wherein each void is an arc-shaped slot and each end of the sliding stand has a round sliding block slideably and rotatably fitted in a corresponding void.

4. The slide-in structure of claim 1, wherein the pushing arm is fastened to the base plate.

5. The slide-in structure of claim 1, wherein the pushing arm has a protruding surface in contact with a sliding stand.

6. The slide-in structure of claim 1, wherein each void is a hole and each end of the sliding stand is rotatably received in a corresponding void.

7. A cradle set for a handheld electronic device, comprising:

a slot;

a base plate;

a sliding stand movably mounted to the base plate;

a pushing element resiliently pushing the sliding stand;

a circuit board secured on the sliding stand;

a flexible printed circuit for electrically connecting the circuit board to a main circuit board; and a connector mounted on the circuit board, extending in the slot of the cradle set for electrically connecting with the handheld electronic device.

8. The cradle set of claim 7, wherein the base plate has a pair of side walls each defining an arc-shape groove, the sliding stand having two ends each having an arc-shape sliding block thereon, the sliding blocks being movably fitted within the grooves, respectively.

9. The cradle set of claim 7, wherein the base plate has a pair of sidewalls each defining an arc-shaped groove, the sliding stand having two ends each having a round sliding bock thereon, the sliding blocks being slideably and rotatably fitted within the grooves, respectively.

10. The cradle set of claim 7, wherein the base has a pair of sidewalls each defining a hole, the sliding stand having two ends rotatably in the holes, respectively.

11. The cradle set of claim 7, wherein the pushing element is fastened to the base plate.

12. The cradle set of claim 11, wherein the pushing element has a protruding surface in contact with the sliding stand.

13. The cradle set of claim 8, wherein the pushing element is fastened to the base place and having a protruding surface in contact with the sliding stand.

14. The cradle set of claim 9, wherein the pushing element is fastened to the base plate and having a protruding surface in contact with the sliding stand.

15. The cradle set of the claim 10, wherein the pushing element is fastened to the base plate and having a protruding surface in contact with the sliding stand.

16. A cradle set for a handheld electronic device, comprising:

a base plate;

a stand movably mounted on the base plate;

a connector fastened to the stand, adapted for electrically connecting with the handheld electronic device;

an element secured to the base plate and providing a resilient force to the stand; and a flexible printed circuit and a circuit board secured to the stand, the connector being mounted on the circuit board and the flexible printed circuit board being electrically connected with the circuit board;

wherein the base plate comprises a pair of arc-shaped grooves and the stand has a pair of ends movably fitted in the grooves, respectively.

* * * * *